US005229242A

United States Patent [19]

Mahabadi et al.

[11] Patent Number: 5,229,242

[45] Date of Patent: Jul. 20, 1993

[54] TONER AND DEVELOPER COMPOSITIONS WITH BLOCK OR GRAFT COPOLYMER COMPATIBILIZER

[75] Inventors: Hadi K. Mahabadi, Toronto; Sheau V. Kao; Gerald R. Allison, both of Oakville; Paul J. Gerroir, Toronto, all of Canada; Hui Chang, Pittsford, N.Y.; Michael S. Hawkins, Mississauga, Canada

[73] Assignee: Xerox Corporation, Stamford, Conn.

[21] Appl. No.: 724,263

[22] Filed: Jul. 1, 1991

[51] Int. Cl.[5] ..... G03G 9/08

[52] U.S. Cl. ..... 430/106.6; 430/110

[58] Field of Search ..... 430/106.6, 137, 110

[56] References Cited

U.S. PATENT DOCUMENTS

| | | | |
|---|---|---|---|
| 3,965,021 | 6/1976 | Clemens et al. | 252/62.1 P |
| 4,100,087 | 7/1978 | Takayama et al. | 430/108 |
| 4,557,991 | 12/1985 | Takagiwa et al. | 430/109 |
| 4,795,689 | 1/1989 | Matsubara et al. | 430/99 |
| 4,804,601 | 2/1989 | Watson | 430/32 |
| 4,894,308 | 1/1990 | Mahabadi et al. | 430/137 |

FOREIGN PATENT DOCUMENTS 1442835 7/1976 United Kingdom .

*Primary Examiner*—Marion E. McCamish
*Assistant Examiner*—Mark A. Chapman
*Attorney, Agent, or Firm*—E. O. Palazzo

[57] ABSTRACT

A toner composition comprised of resin particles, pigment particles, wax component particles, and a compatibilizer.

35 Claims, No Drawings

TONER AND DEVELOPER COMPOSITIONS WITH BLOCK OR GRAFT COPOLYMER COMPATIBILIZER

BACKGROUND OF THE INVENTION

This invention is generally directed to toner and developer compositions, and more specifically the present invention is directed to toner compositions, including magnetic, single component, two component and colored toner compositions wherein more than one polymer, including at least one wax component, can be selected. In one embodiment of the present invention, the toner compositions contain at least two polymers, and in embodiments from about 2 to about 10 polymers comprised, for example, of a first resin, a second crosslinked resin, a wax component, and a compatibilizer component. In an embodiment of the present invention, the toner compositions are comprised of resin particles, especially first resin and second crosslinked resin particles, pigment particles, a wax component, such as polypropylene wax, and a copolymer compatibilizer, such as a block copolymer, or a graft copolymer. There is also provided in accordance with the present invention positively or negatively charged toner compositions comprised of resin particles, pigment particles, a wax component, such as polypropylene wax, and a copolymer compatibilizer, such as a block copolymer, or a graft copolymer, and charge enhancing additives. In addition, the present invention is directed to developer compositions comprised of the aforementioned toners, and carrier particles. Furthermore, in another embodiment of the present invention there are provided single component toner compositions comprised of resin particles, magnetic components, such as magnetites, a wax component, such as polypropylene wax, and a copolymer compatibilizer, such as a block copolymer, or a graft copolymer. The toner and developer compositions of the present invention are useful in a number of known electrostatographic imaging and printing systems, especially those systems wherein a wax is present in the toner. The developer compositions of the present invention in embodiments possess a wide fusing latitude, for example about 100° C., which is the temperature range between the minimum fixing temperature of, for example, from about 100° C. to about 170° C. required for fixing toner particles on paper and the hot, for example, from about 180° C. to about 250° C., offset temperature. The developer compositions of the present invention also provide toner images with low surface energy and a low frictional coefficient, which properties enable the effective release of paper from the fuser roll and provide for a reduction in image smudging. Further, the developer compositions of the present invention possess stable electrical properties for extended time periods, and with these compositions, for example, there is no substantial change in the triboelectrical changing values.

In a patentability search report, the following United States Patents are listed: U.S. Pat. No. 4,795,689 which discloses an electrostatic image developing toner comprising as essential constituents a nonlinear polymer, a low melting polymer, which is incompatible with the nonlinear polymer, a copolymer composed of a segment polymer, which is at least compatible with the nonlinear polymer, and a segment polymer, which is at least compatible with the low melting polymer, and a coloring agent, see the Abstract, and columns 3 to 10 for example; U.S. Pat. No. 4,557,991 which discloses a toner for the development of electrostatic images comprised of a certain binder resin, and a wax comprising a polyolefin, see the Abstract; also see columns 5 and 6 of this patent and note the disclosure that the modified component shows an affinity to the binder and is high in compatibility with the binder, column 6, line 25; and as collateral interest U.S. Pat. No. 3,965,021.

Developer and toner compositions with certain waxes therein, which waxes can be selected as a component for the toners of the present invention, are known. For example, there are illustrated in U.K. Patent Publication 1,442,835, the disclosure of which is totally incorporated herein by reference, toner compositions containing resin particles, and polyalkylene compounds, such as polyethylene and polypropylene of a molecular weight of from about 1,5000 to about 20,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. Also, in U.S. Pat. No. 4,997,739, there is illustrated a toner formulation including polypropylene wax (MW: from about 200 to about 6,000) to improve hot offset. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incoporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

Described in U.S. Pat. No. 4,367,275 are methods of preventing offsetting of electrostatic images of the toner composition to the fuser roll, which toner subsequently offsets to supporting substrates such as papers wherein there is selected toner compositions containing specific external lubricants including various waxes, see column 5, lines 32 to 45.

However, there are various problems observed with the inclusion of polyolefin or other waxes in toners. For example, when a polypropylene wax is included in toner to enhance the release of toner from a hot fuser roll, or to improve the lubrication of fixed toner image it has been observed that the wax does not disperse well in the toner resin. As a result, free wax particles are released during the pulverizing step in, for example, a fluid energy mill and the pulverization rate is lower. The poor dispersion of wax in the toner resin and, therefore, the loss of wax will then impair the release function it is designed for. Scratch marks, for example, on xerographic developed toner solid areas caused by stripper fingers were observed as a result of the poor release. Furthermore, the free wax remaining in the developer will build up on the detone roll present in the xerographic apparatus causing a hardware failure.

All the problems mentioned above, and others can be eliminated, or minimized with the toner compositions and processes of the present invention in embodiments thereof. The release of wax particles is, for example, a result of poor wax dispersion during the toner mechanical blending step. All additives should be dispersed well in the primary toner resin for them to impart their specific functions to the toner and thus the developer. For some of the additives, such as waxes like polypropylene, VISCOL 550P TM that become a separate molten phase during melt mixing, the difference in viscosity between the wax and the resin can be orders of magnitude apart, thus causing difficulty in reducing the wax phase domain size. A more fundamental reason for poor dispersion is due to the inherent thermodynamic incompatibility between polymers. The Flory-Huggins interaction parameter between the resin and the wax is usually positive (repulsive) and large so that the interfacial energy remains very large in favor of phase separation into large domains to reduce interfacial area. Some degree of success has been obtained by mechanical blending the toner formulation in certain types of mixers, such as the known. Banbury mixer, where the temperature of melt can be maintained at a low level and polymer viscosities are not that far apart. However, it has been found difficult to generate an effective wax dispersion in compounding extruders where melt temperatures are typically higher. The inclusion of a compatibilizer of the present invention is designed to overcome the inherent incompatibility between different polymers, and, more specifically, between toner resin and wax, thus widening the processing temperature latitude and enabling the toner preparation in a large variety of equipment, for example an extruder. The improvement in thermodynamic compatibility will also provide for a more stable dispersion of secondary polymer phase, such as wax, in the host resin against gross phase separation over time.

A number of specific advantages are associated with the invention of the present application in embodiments thereof, including improving the dispersion of toner resin particles, especially a mixture of resins and wax; improving the dispersion of wax in the toner, thus eliminating the undesirable release of wax from the toner in the form of free wax particles during the pulverizing operation of the toner manufacturing process and the subsequent contamination of xerographic machine subsystems by these free wax particles; avoiding the pulverizing rate reduction resulting from the poor wax dispersion; maintaining the intended concentration of wax in the toner to provide enhancement during release from the fuser roll and avoiding the undesirable scratch marks caused by the stripper fingers; a wide process latitude can be provided during the mechanical blending operation of the toner manufacturing process; and enabling the effective mechanical blending of toner to be accomplished in a number of devices, including an extruder.

SUMMARY OF THE INVENTION

It is a feature of the present invention to provide toner and developer compositions which possess many of the above noted advantages.

Another feature of the present invention resides in the provision of toner and developer compositions with stable triboelectrical characteristics for extended time periods.

In another feature of the present invention there are provided toner and developer compositions that enable improved dispersion of resin and wax componemts achievable in a number of devices, including an extruder.

Moreover, another feature of the present invention relates to the provision of toner and developer compositions with a compatibilizer, and wherein for the resulting toners there is avoided, or there is minimized the undesirable generation of particles comprised entirely of a secondary polymer component during toner preparation. These particles can impair the function for which the secondary polymer component is designed.

In a further feature of the present invention the toner mechanical blending operation can be accomplished at a melt temperature as high as 50° C. above the melting point of the wax component, thus enabling the use of a large number of apparatuses in addition to a low melt temperature mixing process using equipment such as a Banbury mixer.

In yet another feature of the present invention the secondary polymeric phases in the toner will remain stable and substantial phase separation, especially over extended time periods of, for example, up to three months in embodiments, will not take place.

Additionally, in yet another feature of the present invention there are provided toner and developer compositions with certain waxes therein or thereon that enable images of excellent quality inclusive of acceptable resolutions, and that possess other advantages as illustrated herein such as low surface energy.

Another feature of the present invention resides in the provision of a copolymer compatibilizer in a toner wherein incompatible polymers, including at least one wax component, are present, which copolymer can possess distinct segments or blocks, each compatible with one of the toner resins or toner polymers selected, especially when two toner polymers are selected, one of which is a crosslinked polymer.

Yet another feature of the present invention resides in the provision of processes for the preparation of toner compositions wherein the undesirable escape of the wax contained therein is avoided or minimized.

These and other features of the present invention can be accomplished in embodiments by providing toner and developer compositions. More specifically, the present invention is directed to toner compositions comprised of resin particles, pigment particles inclusive of magnetites, waxes, and a compatibilizer. In one embodiment of the present invention there are provided toner compositions comprised of first resin particles, second crosslinked resin particles, pigment particles, low molecular weight waxes, such as polyethylene, and polypropylene, such as those available from Sanyo Chemicals of Japan as VISCOL 550P TM and VISCOL 660P TM and the like, and as a compatibilizer a block or graft copolymer. Furthermore, there are provided in accordance with the present invention positively charged toner compositions comprised of resin particles, pigment particles, low molecular weight waxes, a compatibilizer, and a charge enhancing additive. Another embodiment of the present invention is directed to developer compositions comprised of the aforementioned toners; and carrier particles.

In addition, in accordance with embodiments of the present invention there are provided developer compositions comprised of toner compositions containing first resin particles like a styrene butadiene resin, second crosslinked resins of, for example, a styrene methacrylate crosslinked with known components such as divinylbenzene, pigment particles such as magnetites, carbon blacks or mixtures thereof, low molecular weight waxes, such as polyethylene, and polypropylene, such as those available from Sanyo Chemicals of Japan as VISCOL 550P TM and VISCOL 660P TM, a compatibilizer comprised of a block or graft copolymer, and an optional charge enhancing additive, particularly, for example, distearyl dimethyl ammonium methyl sulfate, reference U.S. Pat. No. 4,560,635, the disclosure of which is totally incorporated herein by reference, and carrier particles. As carrier components for the aforementioned compositions, there can be selected a number of known materials like steel, iron, or ferrite, particularly with a polymeric coating thereover including the coatings as illustrated in U.S. Ser. No. 751,922, (abandoned) entitled Developer Composition with Specific Carrier Particles, the disclosure of which is totally incorporated herein by reference. One coating illustrated in the aforementioned copending application is comprised of a copolymer of vinyl chloride and trifluorochloroethylene with conductive substances dispersed in the polymeric coating inclusive of, for example, carbon black. One embodiment disclosed in the aforementioned abandoned application is a developer composition comprised of styrene butadiene copolymer resin particles, and charge enhancing additives selected from the group consisting of alkyl pyridinium halides, ammonium sulfates, and organic sulfate or sulfonate compositions; and carrier particles comprised of a core with a coating of vinyl copolymers or vinyl homopolymers.

Illustrative examples of suitable toner resins selected for the toner and developer compositions of the present invention, and present in various effective amounts, such as, for example, from about 70 percent by weight to about 95 percent by weight, include styrene acrylates, styrene methacrylates, styrene butadienes, polyesters, polyamides, epoxy resins, polyurethanes, polyolefins, vinyl resins, polymeric esterification products of a dicarboxylic acid and a diol comprising a diphenol; crosslinked resins; and mixtures thereof. Various suitable vinyl resins may be selected as the toner resin including homopolymers or copolymers of two or more vinyl monomers. Typical vinyl monomeric units include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole; N-vinyl pyrrolidone; and the like. The styrene butadiene copolymers, especially styrene butadiene copolymers prepared by a suspension polymerization process reference, U.S. Pat. No. 4,558,108, the disclosure of which is totally incorporated herein by reference, can be selected as the toner resin in embodiments.

As one toner resin, there can be selected the esterification products of a dicarboxylic acid and a diol comprising a diphenol, which components are illustrated in U.S. Pat. No. 3,590,000, the disclosure of which is totally incorporated herein by reference. Other toner resins include styrene/methacrylate copolymers, styrene/acrylate copolymers, and styrene/butadiene copolymers, especially those as illustrated in the aforementioned patent; and styrene butadiene resins with high styrene content, that is exceeding from about 80 to 85 percent by weight of styrene, which resins are available as PLIOLITES ® and PLIOTONES ® obtained from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol. In preferred embodiments, the toner is comprised of a mixture of resins comprised, for example, of a first resin as illustrated herein like styrene acrylate, styrene methacrylate, or styrene butadiene with a high styrene content, and a second polymer comprised of a crosslinked copolymer of styrene and butyl methacrylate. The aforementioned mixture of first and second resins can contain various effective amounts of each resin, for example from about 50 to about 90, and preferably about 70 weight percent of the first resin, like styrene butadiene, and from about 50 to about 10, and preferably about 30 weight percent of the second resin, like the resin crosslinked with, for example, divinylbenzene.

Numerous well known suitable pigments can be selected as the colorant for the toner particles including, for example, carbon black, like REGAL 330 ®, BLACK PEARLS ®, VULCAN ®, and the like, nigrosine dye, aniline blue, phthalocyanine derivatives, magnetites and mixtures thereof. The pigment, which is preferably carbon black, should be present in a sufficient amount to render the toner composition colored thereby permitting the formation of a clearly visible image. Generally, the pigment particles are present in amounts of from about 2 percent by weight to about 20 percent by weight, and preferably from about 5 to about 10 weight percent, based on the total weight of the toner composition, however, lesser or greater amounts of pigment particles may be selected in embodiments.

When the pigment particles are comprised of known magnetites, including those commercially available as MAPICO BLACK ®, they are usually present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black.

In another embodiment of the present invention there are provided colored toner compositions containing as pigments or colorants known magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, Lithol Scarlett, Hostaperm, and the like. Illustrative examples of cyan materials that may be used as pigments include copper tetra-4(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, Sudan Blue, and the like; while illustrative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. Also, there may be selected red, green, blue, brown, and the like pigments. These pigments are generally present in the toner composition in an amount of from about 2 weight percent to about 15 weight percent, and preferably from about 2 to about 10 weight percent, based on the weight of the toner resin particles.

Examples of low molecular weight, for example from about 1,000 to about 20,000, and preferably from about 1,000 to about 7,000, waxes include those as illustrated in the British 1,442,835 patent publication mentioned herein, such as polyethylene, polypropylene, and the like, especially VISCOL 550P TM and VISCOL 660P TM. The aforementioned waxes, which can be obtained in many instances from Sanyo Chemicals of Japan, are present in the toner in various effective amounts, such as for example from about 0.5 to about 10, and preferably from about 3 to about 7 weight percent. Examples of functions of the wax are to enhance the release of paper after fusing, and providing the fused toner image with lubrication. The release or separation of wax from the toner can reduce these functions. Also, toners with poor wax dispersion have a lower pulverizing rate and the free wax which can remain with the toner will build up on the internal parts of the xerographic cleaning device causing a machine failure.

The compatibilizers generally are comprised of block or graft copolymers of the structure A-b(lock)-B, A-b-B-b-A or A-g(raft)-B with the polymeric segments A and B each being compatible with a different polymer thereby permitting the compatibilizer to serve, for example, as a macromolecular surfactant. Examples of compatibilizers include block copolymers, such as KRATON ® copolymers, available from Shell Chemical Company, and STEREON ® copolymers, available from Firestone Tire and Rubber Company. For example, KRATON G1701X ®, a block copolymer of styrene-ethylene/propylene, KRATON G1726X ®, a block copolymer of styrene-ethylene/butylene-styrene, KRATON G1652 ®, a block copolymer of styrene-ethylene/butylene-styrene, STEREON 730A ®, a block copolymer of styrene and butadiene, and the like are suitable for improving the wax dispersion in styrenic resins. With KRATON G1701X ® the A segment could be the styrene block and the B segment could be an ethylene/propylene block. In embodiments of the present invention, there are provided toners wherein the compatilizer is of the formula A-b-B, A-b-B-b-A or A-g-B wherein A-b-B is a block copolymer of 2 segments, A and B, A-b-B-b-A is a block copolymer of 3 segments, A, B and A, and A-g-B is a graft copolymer of segments A and B, and wherein the polymeric segment A is identical or compatible to one of the polymer components present in the toner composition, that is the toner resin, whereas the polymeric segment B is identical or compatible to the other polymer component in the toner composition, that is for example the wax. Thus, in embodiments the aforementioned compatibilizer can be comprised of rigid units such as styrene with the polymeric segment B being comprised of flexible, rubberlike units such as ethylene/propylene. The molecular weight of polymeric segment A can be from about 3,000 to about 100,000, and the molecular weight of polymeric segment B can be from about 10,000 to about 200,000. The compatibilizer is present in various effective amounts, such as for example from about 0.5 to about 5, and preferably from about 1 to about 3 weight percent in embodiments.

Illustrative examples of optional charge enhancing additives present in various effective amounts, such as for example from about 0.1 to about 20, and preferably from 1 to about 5 weight percent by weight, include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives; and the like.

With further respect to the toner and developer compositions of the present invention, a component that may be present therein is the linear polymeric alcohol comprised of a fully saturated hydrocarbon backbone with at least about 80 percent of the polymeric chains terminated at one chain end with a hydroxyl group, which alcohol is represented by the following formula $$CH_3(CH_2)_nCH_2OH$$

wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, in a preferred embodiment of the present invention the polymeric alcohols selected have a number average molecular weight as determined by gas chromatography of from about greater than 450 to about 1,400, and preferably of from about 475 to about 750. In addition, the aforementioned polymeric alcohols can be present in the toner and developer compositions illustrated herein in various effective amounts, and can be added as uniformly dispersed internal, or as finely divided uniformly dispersed external additives. More specifically, the polymeric alcohols can be present in an amount of from about 0.05 percent to about 20 percent by weight. Therefore, for example, as internal additives the polymeric alcohols are present in an amount of from about 0.5 percent by weight to about 20 percent by weight, while as external additives the polymeric alcohols are present in an amount of from about 0.05 percent by weight to slightly less than about 5 percent by weight. Toner and developer compositions with the waxes present internally are formulated by initially blending the toner resin particles, pigment particles, and polymeric alcohols, and other optional components. In contrast, when the polymeric alcohols are present as external additives, the toner composition is initially formulated comprised of, for example, resin particles and pigment particles; and subsequently there is added thereto finely divided polymeric alcohols.

Illustrative examples of carrier particles that can be selected for mixing with the toner compositions of the present invention include those particles that are capable of triboelectrically obtaining a charge of opposite polarity to that of the toner particles. Accordingly, the carrier particles can be selected so as to be of a negative polarity thereby enabling the toner particles which are positively charged to adhere to and surround the carrier particles. Alternatively, there can be selected carrier particles with a positive polarity enabling toner compositions with a negative polarity. illustrative examples of known carrier particles that may be selected include granular zircon, granular silicon, glass, steel, nickel, iron, ferrites, like copper zinc ferrites, available from Steward Chemicals, and the like. The carrier particles may include thereon known coatings like fluoropolymers, such as KYNAR ®, polymethylacrylate, and the like. Examples of specific coatings that may be selected include a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride, and trichlorofluoroethylene; and other known coatings. There can also be selected as carriers components comprised of a core with a mixture, especially two, polymer coatings thereover, reference U.S. Pat. Nos. 4,937,166 and 4,935,326, the disclosures of which are totally incorporated herein by reference. Examples of carrier particles disclosed in the aforementioned patents can be prepared by (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000 microns, and preferably from about 75 to about 200 microns, thus allowing these particles to possess sufficient density and inertia to avoid adherence to the electrostatic images during the development process. The carrier particles can be mixed with the toner particles in various suitable combinations, such as from about 1 to about 3 parts per toner to about 100 parts to about 200 parts by weight of carrier.

The toner compositions of the present invention can be prepared by a number of known methods, including mechanical blending and melt blending the toner resin particles, pigment particles or colorants, compatibilizer, optional additives, and polymeric waxes followed by mechanical attrition including classification. Other methods include those well known in the art such as spray drying, mechanical dispersion, melt dispersion, dispersion polymerization, and suspension polymerization. The toner particles are usually pulverized, and classified, thereby providing a toner with an average volume particle diameter of from about 7 to about 25, and preferably from about 10 to about 15 microns as determined by a Coulter Counter. The toner compositions of the present invention are particularly suitable for preparation in a compounding extruder such as a corotating intermeshing twin screw extruder of the type supplied by the Werner & Pfleiderer Company of Ramsey, N.J. The inclusion of compatibilizer improved the thermodynamic compatibility between the primary and the secondary polymer phases. As a result, the secondary polymer can be well dispersed into smaller domain size with improved adhesion to the primary resin. The smaller domain size and the better adhesion will then prevent the secondary polymer from separating into individual particles during the pulverization operation. Furthermore, the compatibilizing action can be functioning even at high melt temperatures, for example 50° C. above the melting point of the wax component when mechanical blending is difficult because of a vast difference in polymer viscosity. This advantage increases the process latitude of the mechanical blending operation. The advantage of including a compatibilizer may not be limited to the mechanical blending process alone; thus, for example, improved dispersion and adhesion can be realized in other known preparation methods by using the toner compositions of the present invention. Also, high concentrations of a secondary polymer, such as wax, can be effectively dispersed in a toner by including an effective amount of compatibilizer.

The toner and developer compositions of the present invention may be selected for use in developing images in electrostatographic imaging systems containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, titanyl phthalocyanines, and vanadyl phthalocyanines, while examples of charge transport layers include the aryl amines as disclosed in U.S. Pat. No. 4,265,990, the disclosure of which is totally incorporated herein by reference. Moreover, there can be selected as photoconductors hydrogenated amorphous silicon, and as photogenerating pigments squaraines, perylenes, and the like.

The toner and developer compositions of the present invention can be particularly useful with electrostatographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone.

The following examples are provided, wherein parts and percentages are by weight unless otherwise indicated. A comparative Example is also provided.

EXAMPLE I

A toner composition comprised of 63.4 percent by weight of a styrene butadiene resin with 91 percent by weight of styrene and 9 percent by weight of butadiene, 19.1 percent by weight of a crosslinked, with 2 weight percent of divinyl benzene, styrene butylmethacrylate resin, 5 percent by weight of the polypropylene wax VISCOL 550P TM, available from Sanyo Chemicals of Japan, 10 percent by weight of REGAL 330 ® carbon black, 2 percent by weight of a styrene-ethylene/butylene-styrene block copolymer (Shell KRATON G1726X ®), and 0.5 percent by weight of the charge enhancing additive distearyl dimethyl ammonium methyl sulfate, was prepared by mechanically blending the aforementioned components using a Werner & Pfleiderer ZSK30 twin screw extruder at barrel set temperatures ranging from 90° to 140° C. After pulverization and classification, toner particles with volume average diameter of about 11 microns as measured by a Coulter Counter, were obtained. The percent by weight of the free wax particles was determined to be less than 0.01 for all toners prepared. (The free wax particles did not contain carbon black and, therefore, were lighter than the normal toner particles. A centrifugal separation technique based on the difference in specific gravity was then used to separate the lighter wax particles and determine the percent by weight of wax particles). Transmission electron microscope analysis of the above toner showed that domains of wax and crosslinked resin components were about 1 micron, the longest projected dimension measured on a TEM photomicrograph; all particles or domains were nonspherical; or less in the styrene butadiene continuous phase. The total wax remained inside the toner particles as determined by a differential scanning calorimeter and was found to be about 5 percent by weight, indicating the retention of all wax in the toner.

Subsequently, there was prepared a developer composition by admixing the aforementioned formulated toner composition mechanically blended in an extruder at 130° C. at a 4.5 percent toner concentration, that is 4.5 parts by weight of toner per 100 parts by weight of carrier with carrier comprised of a steel core with a coating, 0.8 weight percent thereover of a polyvinylidine flouride and polymethyl methacrylate. Thereafter, the formulated developer composition was incorporated into an electrostatographic imaging device with a toner transporting means, a toner metering charging means, and a development zone as illustrated in U.S. Pat. No. 4,394,429. A test run of 20,000 copies was carried out. The copy quality was judged excellent with good solid area and lines and no background throughout the aforementioned imaging test. The paper was released easily after the toner image was fused and no scratching was caused by stripper fingers present in the imaging device on developed solid areas as determined by visual examination.

EXAMPLE II

A toner was prepared by repeating the procedure of Example I with the exception that a styrene-ethylene/propylene block copolymer (Shell KRATON G1701X ®) was selected as the compatibilizer instead of the styrene-ethylene/butylene-styrene block copolymer. The percent by weight of the free wax particles, determined by the same process as illustrated in Example I, was less than 0.01 weight percent for this toner.

Subsequently, there was prepared a developer composition by admixing the aforementioned formulated toner composition mechanically blended at 130° C. at a 4.5 percent toner concentration. The prepared developer composition was then incorporated into the same electrostatographic imaging device of Example I, and a test run of 20,000 copies was accomplished. The copy quality for the developed images was excellent throughout the test. The paper was released easily after fusing and no scratching was caused by stripper fingers on developed solid areas as determined by visual examination.

EXAMPLE III (COMPARATIVE)

A toner composition comprised of 63.4 percent by weight of a styrene butadiene resin with 91 percent by weight of styrene and 9 percent by weight of butadiene, 21.1 percent by weight of the crosslinked styrene butylmethacrylate resin of Example I, 5 percent by weight of the polypropylene wax of Example I, 10 percent by weight of REGAL 330 ® carbon black, and 0.5 percent by weight of the charge enhancing additive distearyl dimethyl ammonium methyl sulfate was mechanically blended using a Werner & Pfleiderer ZSK30 twin screw extruder at barrel set temperature of 130° C. After pulverization and classification, toner particles with volume average diameter of about 11 microns were obtained. The separation technique as in Example I showed that the percent by weight of the free wax particles was 0.06. Transmission electron microscope analysis of toner showed that wax domains larger than 2 to 3 microns in the longest projected dimension were observed in the styrene butadiene continuous phase. The total wax remaining inside the toner particles as determined by a differential scanning calorimeter was found to be only 3.3 percent by weight.

Subsequently, there was prepared a developer composition by admixing the aforementioned formulated toner composition at a 4.5 percent toner concentration with the carrier particles of Example I. The prepared developer composition was then incorporated into the same electrostatographic imaging device of Example I, and a test run was carried out. Scratch marks caused by stripper fingers were visible on the developed solid areas.

Other modifications of the present invention may occur to those skilled in the art subsequent to a review of the present application. The aforementioned modifications, including equivalents, thereof, are intended to be included within the scope of the present invention.

What is claimed is:

1. A toner composition consisting essentially of first resin particles, second crosslinked resin particles, pigment, wax component particles, and a compatibilizer comprised of a graft copolymer, or a block copolymer; and wherein said compatibilizer is of the formula A-b-B, A-b-B-b-A or A-g-B wherein A-b-B is a block copolymer of 2 segments; A and B, A-b-B-b-A is a block copolymer of 3 segments; and A-g-B is a graft copolymer of segments A and B, and wherein said wax component is substantially retained in the toner composition.

2. A toner composition in accordance with claim 1 wherein the compatibilizer is a styrene-ethylene/butylene block copolymer, a styrene-ethylene/propylene block copolymer, or a styrene-ethylene/butylene-styrene block copolymer.

3. a toner composition in accordance with claim 2 wherein the first resin is selected from the group consisting of polyesters, styrene butadiene copolymers, styrene acrylate copolymers, and styrene methacrylate copolymers.

4. A toner composition in accordance with claim 3 wherein the styrene butadiene copolymer contains 91 percent by weight of styrene, and 9 percent by weight of butadiene.

5. A toner composition in accordance with claim 3 wherein there is selected a suspension polymerized styrene butadiene.

6. A developer composition comprised of the toner composition of claim 2, and carrier particles.

7. A developer composition in accordance with claim 6 wherein the carrier particles are comprised of a core with a polymeric coating thereover.

8. A developer composition in accordance with claim 6 wherein the carrier particles are comprised of a steel or a ferrite core with a coating thereover selected from the group consisting of polychlorotrifluoroethylene-co-vinylchloride copolymer, a polyvinylidene fluoropolymer, a terpolymer of styrene, methacrylate, and an organo silane, fluorinated ethylene-propylene copolymers, and polytetrafluoroethylene.

9. A method for obtaining images which comprises generating an electrostatic latent image on a photoconductive imaging member, subsequently affecting development of this image with the toner composition of claim 2, thereafter transferring the image to a permanent substrate, and optionally permanently affixing the image thereto.

10. A toner composition in accordance with claim 1 wherein the compatibilizer is present in an amount of from about 0.5 to about 10 weight percent.

11. A toner composition in accordance with claim 1 wherein the compatibilizer is present in an amount of from about 1 to about 3 percent.

12. A toner composition in accordance with claim 1 wherein the first resin particles are selected from the group consisting of polyesters, styrene butadiene copolymers, styrene acrylate copolymers, and styrene methacrylate copolymers.

13. A toner composition in accordance with claim 12 wherein the polyester results from the condensation reaction of dimethylterephthalate, 1,2-propanediol, 1,3-butanediol, and pentaerythritol; or wherein the polyester results from the condensation reaction of dimethylterephthalate, 1,2-propanediol, diethylene glycol, and pentaerythritol.

14. A toner composition in accordance with claim 1 wherein the first resin particles are present in an amount of from about 40 to about 90 weight percent, and second resin particles are present in an amount of from about 60 to about 10 weight percent.

15. A toner composition in accordance with claim 1 wherein the second resin particles are comprised of crosslinked polymer of styrene butadiene, styrene acrylate, or styrene methacrylate.

16. A toner composition in accordance with claim 14 wherein the first resin is present in an amount of from about 50 weight percent to about 85 weight percent, and the second resin is present in an amount of from about 10 weight percent to about 40 weight percent.

17. A toner composition in accordance with claim 1 wherein the pigment is carbon black.

18. A toner composition in accordance with claim 1 wherein the pigment is magnetite.

19. A toner composition in accordance with claim 1 wherein the pigment is comprised of a mixture of carbon black and magnetites.

20. A toner composition in accordance with claim 1 wherein the pigment is selected from the group consisting of magenta, cyan, yellow, and mixtures thereof.

21. A toner composition in accordance with claim 1 wherein the wax has a weight average molecular weight of from about 1,000 to about 10,000.

22. A toner composition in accordance with claim 1 wherein the wax is a polyolefin, or mixture of polyolefins.

23. A toner composition in accordance with claim 22 wherein the polyolefin is polyethylene or polypropylene.

24. A toner composition in accordance with claim 1 wherein the wax is a polyolefin, or mixture of polyolefins comprised of polyethylene or polypropylene.

25. A toner composition in accordance with claim 1 wherein the wax is present in an amount of from about 1 to about 10 weight percent.

26. A toner composition in accordance with claim 1 wherein the wax is present in an amount of from about 2 to about 7 weight percent.

27. A toner composition in accordance with claim 1 containing a charge enhancing additive selected from the group consisting of distearyl dimethyl ammonium methyl sulfate, a cetyl pyridinium halide, and stearyl phenethyl dimethyl ammonium tosylate.

28. A developer composition comprised of the toner composition of claim 1, and carrier particles.

29. A developer composition in accordance with claim 28 wherein the carrier particles are comprised of a core with a polymeric coating thereover.

30. A method for obtaining images which comprises generating an electrostatic latent image on a layered photoconductive imaging member, subsequently affecting development of this image with the toner composition of claim 1, thereafter transferring the image to a permanent substrate, and optionally permanently affixing the image thereto.

31. A toner in accordance with claim 1 wherein the compatibilizer is a copolymer A-B wherein the A segment is compatible with the first toner polymer component, and the polymeric segment B is compatible to the second toner polymer component.

32. A toner in accordance with claim 31 wherein the second toner polymer component is a wax.

33. A toner composition in accordance with claim 1 wherein the polymeric segment A of the compatibilizer is comprised of rigid styrene segments, and the polymeric segment B is comprised of flexible, rubber-like segments.

34. A toner composition in accordance with claim 1 wherein the molecular weight of the polymeric segment A is from about 3,000 to about 100,000, and the molecular weight of polymeric segment B is from about 10,000 to about 200,000 for the compatibilizer.

35. A toner composition in accordance with claim 1 wherein the first resin particles are styrene butadiene, the crosslinked resin particles are styrene butylmethacrylate crosslinked with divinyl benzene, the wax is polypropylene, the pigment is carbon black, and the compatilibilizer is a styrene ethylene/butylene styrene block copolymer, and the toner contains as a charge enhancing additive distearyl dimethyl ammonium methyl sulfate.

* * * * *